US005598196A

United States Patent [19]

Braun

[11] Patent Number: 5,598,196

[45] Date of Patent: Jan. 28, 1997

[54] PIEZOELECTRIC INK JET PRINT HEAD AND METHOD OF MAKING

[75] Inventor: Hilarion Braun, Beaver Creek, Ohio

[73] Assignee: Eastman Kodak Company, Rochester, N.Y.

[21] Appl. No.: 871,775

[22] Filed: Apr. 21, 1992

[51] Int. Cl.[6] ..... B41J 2/045

[52] U.S. Cl. ..... 347/68; 347/69; 29/25.35

[58] Field of Search ..... 346/1.1, 140 R; 310/333, 363–366; 29/25.35, 890.1, 592.1; 228/179; 347/68, 69, 71

[56] References Cited

U.S. PATENT DOCUMENTS

| | | | |
|---|---|---|---|
| 5,235,352 | 8/1993 | Pies et al. | 346/140 R |
| 5,463,414 | 10/1995 | Temple et al. | 347/68 |

FOREIGN PATENT DOCUMENTS

| | | | |
|---|---|---|---|
| A-0277703 | 8/1988 | European Pat. Off. | B41J 3/04 |
| A-0364136 | 4/1990 | European Pat. Off. | B41J 2/155 |
| A-0484983 | 5/1992 | European Pat. Off. | B41J 2/135 |
| 4016501A1 | 10/1990 | Germany | B41J 2/05 |
| A-9222429 | 12/1992 | WIPO | B41J 2/045 |

*Primary Examiner*—Huan H. Tran
*Attorney, Agent, or Firm*—Milton S. Sales

[57] ABSTRACT

A piezoelectric ink jet print head includes a body of piezoelectric material defining a plurality of parallel open topped channels having electrodes on opposite walls thereof. A top cover having a pattern of parallel conductors congruent with the open tops of the parallel channels is secured to the body by reflow soldering the conductors to the electrodes. The resulting solder bond is very stiff, thereby improving the performance of the print head, and the conductors provide convenient electrical contact to the electrodes.

13 Claims, 2 Drawing Sheets

PIEZOELECTRIC INK JET PRINT HEAD AND METHOD OF MAKING

FIELD OF THE INVENTION

The present invention relates to drop-on-demand ink jet printing apparatus, and more particularly ink jet printing apparatus of the type employing a piezoelectric ink jet printhead having a body of piezoelectric material defining an array of parallel channels.

BACKGROUND OF THE INVENTION

A high density, multi channel ink jet printhead is disclosed in U.S. Pat. No. 5,016,028 issued May 14, 1991 to Temple. The printhead includes a sheet-like body of piezoelectric material poled in a direction normal to the sheet and having a plurality of parallel channels mutually spaced in an array direction normal to the length of the channels. Each channel is defined by facing side walls and a bottom surface extending between the side walls. Electrodes of a suitable metal such as nickel chromium, i.e. nichrome, are provided on opposite sides of the side walls to form shear mode actuators for effecting droplet expulsion from the channels associated with the actuators. Each electrode extends substantially along the length of the corresponding side wall. A top sheet is disposed parallel to the bottom surface of the channels and is bonded to the tops of the side walls to enclose the channels.

A problem arises in effecting a suitable bond between the top sheet and the piezoelectric body when the body is of a porous piezoelectric ceramic such as PZT. For most efficient print head operation, the bond between the top sheet and the tops of the side walls defined by the body, needs to be as stiff (non compliant in the shear mode) as possible. To form non compliant bonds in the shear mode, adhesives such as thermosetting plastics need to be applied in very thin layers. Layers of the desired thinness are difficult to achieve however on a porous surface such as PZT.

SUMMARY OF THE INVENTION

It is the object of the invention to provide a piezoelectric print head that overcomes the problem noted above with respect to the prior art. The object is accomplished according to the present invention by providing a piezoelectric ink jet print head having a body of piezoelectric material defining a plurality of parallel open topped channels separated by walls. The walls have metal electrodes on opposite sides thereof to form shear mode actuators for effecting droplet expulsion from the channels. A top cover of insulating material having a pattern of parallel metal conductors aligned with the open tops of the channels and extending beyond the body in a direction parallel with the channels is bonded to the body of piezoelectric material by solder joints between the conductors on the top cover and the electrodes on the side walls. The extension of the top cover and conductors beyond the body of piezoelectric material provides convenient electrical contact to the electrodes. In a preferred method of making the piezoelectric ink jet print head, a low temperature solder is applied to the conductors and the electrodes, the top cover is positioned on the body of piezoelectric material, and the print head is heated to reflow the solder to form the bond.

A print head according to the present invention is advantageous in that the solder bond between the side walls of the actuator and the top cover is very stiff in the shear mode, thereby improving the performance of the actuator. The print head has the further advantage that the metal conductors on the top cover extending beyond the body of piezoelectric material provide a convenient means for electrical contact with the print head electrodes, thereby resulting in a simplified print head construction.

MODES OF CARRYING OUT THE INVENTION

Figure 1:
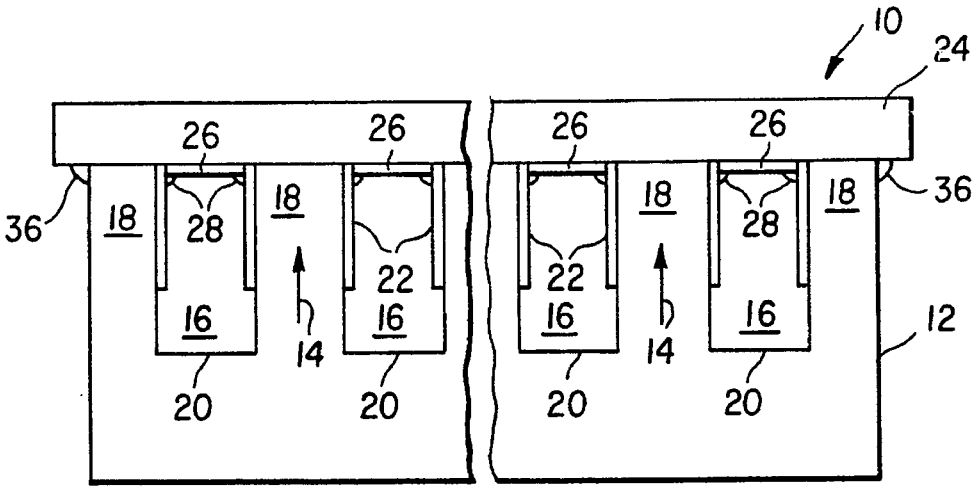
FIG. 1 is a greatly enlarged schematic front view of an ink jet print head according to the present invention.

Referring to FIG. 1, an ink jet print head 10 includes a body 12 of piezoelectric material, preferably PZT, poled in the direction of arrows 14. The body 12 defines a plurality of ink channels 16 spaced in an array direction perpendicular to the length of the channels 16. Each channel 16 is defined by a pair of side walls 18 and a bottom surface 20. Side walls 18 carry metal electrodes 22 which preferably extend from the top edges of walls 18 to a location short of the bottom surface 20 of the channels. The channels 16 are covered by a top cover 24 comprising a sheet of insulating material upon which is formed a pattern of electrical conductors 26. Preferably, the top cover 24 is thermally matched to the print head body 12. Electrical conductors 26 on top cover 24 are sized and spaced to fit neatly between the top edges of electrodes 22, as shown in FIG. 1, along the entire lengths of respective channels 16.

Figure 2:
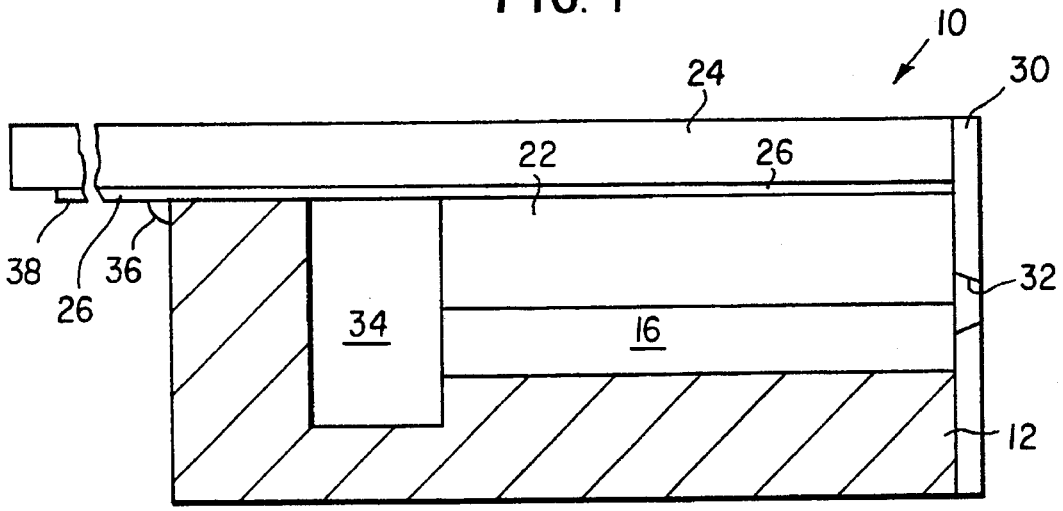
FIG. 2 is a sectional side view of the ink jet print head of FIG. 1.

As shown in FIG. 2, an orifice plate 30 defining a row of orifices 32, one such orifice for each channel, is bonded to the front surface of the print head 10. For purpose of illustration, the orifice plate 30 was omitted from FIG. 1. The top cover 24, bearing electrical conductors 26 extends beyond the rear of print head body 12.

Figure 3:
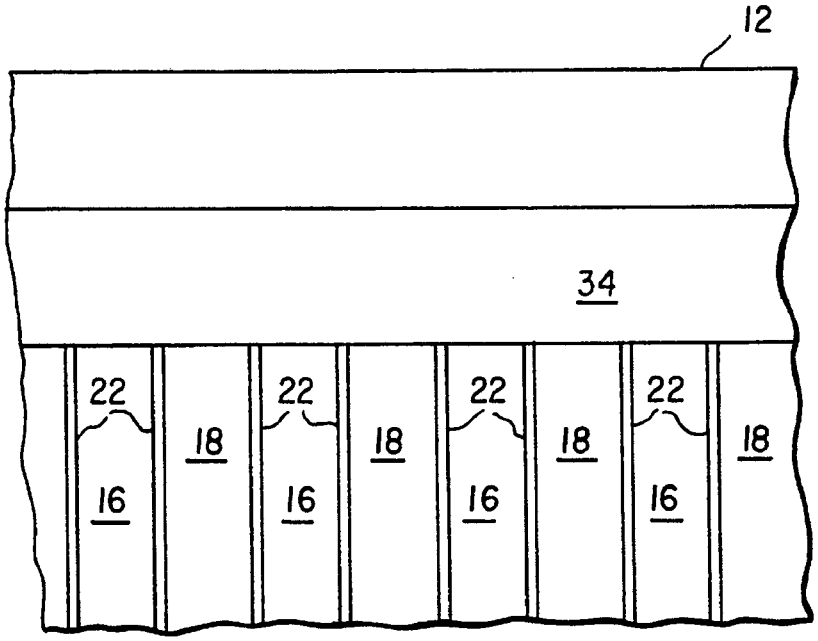
FIG. 3 is a partial top view of the body portion of a print head according to the present invention.

An ink manifold 34 runs transversely at the backs of channels 16 to connect each channel to a supply of ink, not shown. FIG. 3 shows a top view of the print head body 12 with the top cover removed and showing the ink manifold 34 communicating with the backs of channels 16.

Figure 4:
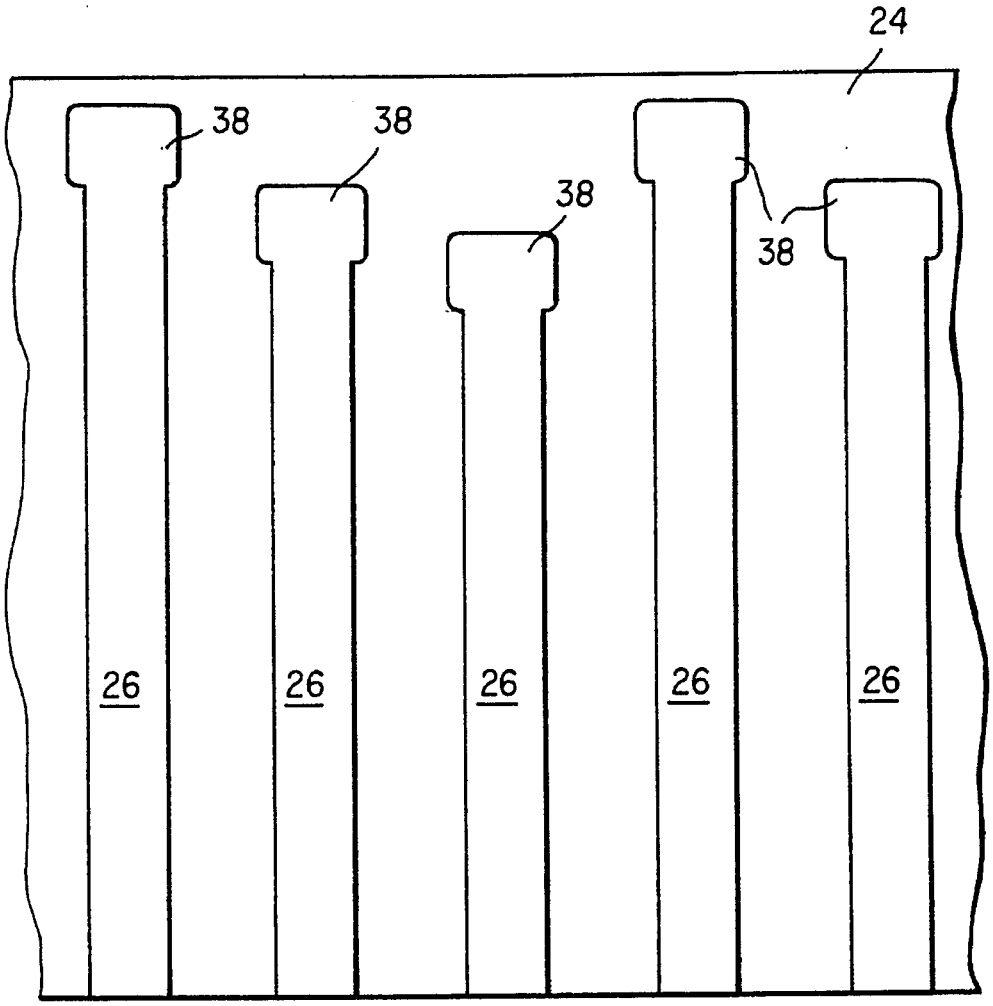
FIG. 4 is a partial view of the underside of the top cover of the print head according to the present invention, showing the electrical connector pattern thereon.

FIG. 4 shows the underside of top cover 24, illustrating the pattern of electrical conductors 26. Preferably the electrical conductors terminate in a pattern of electrical contact pads 38 that are accessible from the exterior of the print head under the overhanging portion of the top cover 24 as shown in FIG. 2. Referring to FIG. 1, the top cover 24 is secured to the print head body 12 by solder joints 28 between the conductors 26 and the electrodes 22 along the top edges of the channels 16.

As shown in FIG. 1, a bead of adhesive 36 such as thermosetting epoxy is employed to seal the side joints between the top cover 24 and print head body 12. Similarly, as shown in FIG. 2, a bead of adhesive 36 is employed to seal the rear joint between the top cover 24 and the body 12. Orifice plate 30 effectively seals the front joint. In this way, ink is prevented from seeping out of the print head between the top cover 24 and the body 12.

When potential differences are applied via conductors 26 across the electrodes 22 on opposite faces of a wall 18, the wall 18 is subjected to an electrical field in a direction perpendicular to the poling direction 14, resulting in a shear mode deflection of the wall 18. When adjacent walls of a channel 16 are thus caused to deflect inwardly, fluid such as ink in channel 16 is subjected to a sudden and controlled increase in pressure, causing a drop to be ejected from orifice 32.

The channels 16 may be arranged in groups of odd and even numbered channels, and selected channels of each group may be activated simultaneously and alternately with channels of the other group, as taught in the prior art.

The feature of securing the top cover 24 to the print head body 12 by means of solder, is advantageous in that the solder bond is very stiff in the shear mode, thereby resulting in improved efficiency of deflection of walls 18. The conductors 26 on the top cover also provide convenient electrical contact to the electrodes 22.

In making a print head according to the present invention, the top cover 24 with its pattern of electrodes 26 is fabricated using standard printed circuit board processes and materials. The conductors 26 are "tinned" with a coating of low temperature solder such as indium/bismuth solder.

The piezoelectric body 12 is formed as taught in the prior art by using diamond saws to cut the channels 16 and the ink manifold 34 from a sheet of poled piezoelectric ceramic material. The metal electrodes 22 are formed on walls 18 as taught is U.S. Pat. No. 5,016,028, preferably of nickel, by shadow evaporation of the metal onto the walls. A layer of the low temperature solder is applied over the metal electrodes 22 preferably by flash vapor deposition after the electrodes have been deposited. Any excess solder and/or electrode metal may be removed from the tops of walls 18 by lapping as taught in the prior art.

The top cover 24 is then located and held in its proper position with respect to the print head body 12, and the print head is heated to a temperature of about 120° C. preferably in an inert atmosphere to avoid oxidation of the solder, to reflow the solder and bond the top cover 24 to the body 12.

After the top cover 24 is soldered to the body 12, the orifice plate 30 is bonded to the front of the print head, and the bead of adhesive 36 is applied and cured around the joint between the top cover 24 and the body 12.

Figure 5:
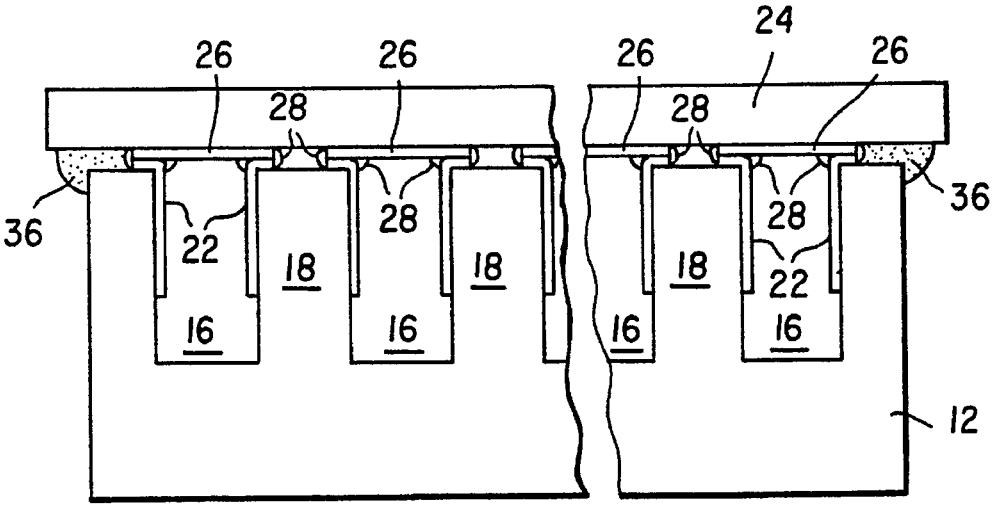
FIG. 5 is a schematic front view of an alternative embodiment of an ink jet print head according to the present invention.

Referring now to FIG. 5, an alternative configuration of an ink jet print head according to the present invention is shown. In this configuration, the electrodes 22 extend partially over the tops of walls 18, and the conductors 26 on top cover 24 are slightly wider than channels 16. The top cover 24 is secured to the body 12 by reflow soldering as described above, resulting in a slightly larger bonding area. Similar to the previous example, a bead of adhesive 36 is employed to seal the joint between the top cover 24 and body 12. A method of forming electrodes which partially overlap the top of the walls is shown in published European Patent Application number 0397441A2, published 14 Nov. 1990, entitled "Method of Forming a Pattern on a Surface."

I claim:

1. A piezoelectric ink jet print head, comprising:

a) a body of piezoelectric material having a plurality of parallel open topped channels separated by walls, said walls having metal electrodes on opposite sides thereof to form shear mode actuators for effecting droplet expulsion from the channels;

b) a top cover of insulating material having a pattern of parallel metal conductors aligned with the open tops of said channels and extending beyond said body in a direction parallel with said channels; and c) said top cover being attached to said body by solder joints between said conductors and said electrodes, and wherein said conductors provide electrical contact to said electrodes.

2. The apparatus claimed in claim 1, wherein said metal conductors and said selectrodes are nickel and said solder joints are indium bismuth solder.

3. The apparatus claimed in claim 1, wherein the channels have a plurality of ends, and further comprising an orifice plate over one end of said channels for ejection of droplets of ink therefrom.

4. The apparatus claimed in claim 1, further comprising means associated with said body of piezoelectric material for defining an ink manifold for supplying ink to said channels.

5. The apparatus claimed in claim 1, further comprising a bead of adhesive along a joint formed by a junction of the top cover and the body to prevent ink from seeping from the print head along the joint.

6. A method of making a piezoelectric inkjet print head comprising the steps of:

a) forming a body of piezoelectric material having a plurality of parallel open topped channels separated by walls;

b) forming metal electrodes on opposite sides of said walls;

c) forming a top cover of insulating material having a pattern of parallel metal conductors congruent with the open tops of said channels;

d) coating said electrodes and said conductors with solder;

e) placing said top cover on said body; and f) heating said top cover and said body to reflow said solder to bond said top cover to said body.

7. The method claimed in claim 6, further comprising the step of:

forming a bead of adhesive where the top cover is bonded to the body.

8. The method claimed in claim 6, further comprising the step of:

bonding an orifice plate over one end of said channels in said body.

9. A piezoelectric ink jet print head, comprising:

a) a sheet of piezoelectric material, said sheet having a surface, being poled in a direction normal to said sheet surface, and defining a plurality of parallel channels mutually spaced in an array direction normal to a length of said channels, each of said channels being defined by facing side walls, a top, and a bottom surface extending between respective side walls, each of said side walls including side electrodes on opposite sides thereof to form shear mode actuators for effecting droplet expulsion from the channels, each side electrode extending along the length of a corresponding side wall; and b) a top sheet of insulating material having a pattern of parallel top electrodes formed thereon, said top electrodes being aligned with and facing the tops of said channels, and being attached by solder to said side electrodes to attach said top sheet to said print head and to close said channels at the tops thereof.

10. The apparatus of claim 9, wherein said top sheet and top electrodes extend beyond said sheet of piezoelectric material in a direction parallel to said channels.

11. The apparatus of claim 9, wherein said sheet of piezoelectric material further defines an ink manifold communicating with said channels.

12. A method of making a piezoelectric ink jet print head, comprising the steps of:

a) forming a sheet of piezoelectric material having a surface, said sheet being poled in a direction normal to said sheet surface and defining a plurality of parallel-direction channels mutually spaced in an array direction normal to the parallel-direction of said channels, each of said channels being defined by facing side walls and a bottom surface extending between respective side walls, each of said side walls including side electrodes on opposite sides thereof to form shear mode actuators for effecting droplet expulsion from the channels, each side electrode extending along a length of a corresponding side wall;

b) forming a top sheet of insulating material having a pattern of parallel top electrodes, said top electrodes being congruent with tops of said channels in said sheet of piezoelectric material; and c) bonding by reflow soldering said top sheet to said sheet of piezoelectric material such that said top electrodes are attached to respective pairs of said side electrodes to close said channels at the top thereof.

13. The method claimed in claim 12, further comprising the step of forming a bead of adhesive around a joint between the top sheet and the sheet of piezoelectric material.

* * * * *